US011752613B2

(12) United States Patent
Christian

(10) Patent No.: US 11,752,613 B2
(45) Date of Patent: Sep. 12, 2023

(54) MANUALLY OPERATED CONVERTIBLE UTILITY KNIFE AND SCRAPER

(71) Applicant: Andrew Christian, Tucson, AZ (US)

(72) Inventor: Andrew Christian, Tucson, AZ (US)

( * ) Notice: Subject to any disclaimer, the term of this patent is extended or adjusted under 35 U.S.C. 154(b) by 15 days.

(21) Appl. No.: 17/302,715

(22) Filed: May 11, 2021

(65) Prior Publication Data

US 2022/0362917 A1 Nov. 17, 2022

(51) Int. Cl.
*B25F 1/04* (2006.01)
*B26B 5/00* (2006.01)

(52) U.S. Cl.
CPC ..... *B25F 1/04* (2013.01); *B26B 5/003* (2013.01)

(58) Field of Classification Search
CPC ..... B25F 1/04; B26B 5/003
See application file for complete search history.

(56) References Cited

U.S. PATENT DOCUMENTS 2,133,087 A 10/1938 Ericsson
2,164,050 A 6/1939 Brown
2,242,900 A * 5/1941 Bender ..... B26B 5/006 30/154
2,870,537 A 1/1959 Ortner
3,518,758 A 7/1970 Bennett
4,242,795 A 1/1981 Rollband et al.
6,000,137 A * 12/1999 Gamba ..... B26B 5/00 30/169
8,739,414 B2 6/2014 Tyers
10,589,436 B1 3/2020 Panosian et al.
2019/0176349 A1 6/2019 Hansen et al.
2022/0362917 A1* 11/2022 Christian ..... B25F 1/04

* cited by examiner

*Primary Examiner* — Hwei-Siu C Payer
(74) *Attorney, Agent, or Firm* — University of Arizona IP Clinic

(57) ABSTRACT

Embodiments are described for a simple convertible utility knife and scraper includes a handle, slide mechanism, and flat spring with a centrally mounted utility blade. The flat spring locks into precut positions in the handle to secure the blade in the desired position, whether in a cutting position or a scraping position. The blade can be partially extended to expose the front of the blade in the cutting position. When the slide is fully extended, the blade can rotate about a central axis to a position perpendicular to the handle and then be retracted into slots at the end of the handle to secure and support the blade in the scraper position.

5 Claims, 9 Drawing Sheets

MANUALLY OPERATED CONVERTIBLE UTILITY KNIFE AND SCRAPER

FIELD OF DEVELOPMENT

The embodiments of the device generally relate to the field of hand tools and specifically retractable utility knives and scrapper blades.

DESCRIPTION OF RELATED ART

Utility knives typically have a retractable utility blade mounted and locked into position parallel to the knife's handle for cutting and slicing. Scrapper blades typically have a fixed blade mounted perpendicular to the handle for scrapping flat surfaces such as windows or drywall. Most commonly, they are found as two separate tools.

Several designs have incorporated the two tools into one by allowing for the rotation of a utility blade between the perpendicular and parallel positions. U.S. Pat. Nos. 3,518,758, 8,739,414, and 10,589,436 each propose a knife with a rotatable blade. All three patents use a specially designed carriage to hold the blade.

U.S. Pat. No. 3,518,758 proposes a utility knife in which the blade may be rotated into several different positions. The tool uses a cam system to lock the blade into the various positions, which causes the tool to be a large size and contain a complicated locking mechanism.

U.S. Pat. No. 8,739,414 proposes a multi-function tool capable of accepting a utility blade mounted into a special carriage. The carriage system acts to support the blade, as well as adapt the tool to accept the utility blade. The apparatus, which is screwed together while outside of the tool, needs to be removed from the tool and disassembled to replace the blade.

U.S. Pat. No. 10,589,436 proposes a retractable utility knife and scrapper with a rotatable blade. The '436 patent does not use a screw mechanism to secure the blade, but rather utilizes a special carriage and a spring mechanism for single-action operation of both the retracting/extending function and for the rotating function of the blade. The carriage is also necessary for supporting the utility blade when it is in the scrapping position.

SUMMARY OF EMBODIMENTS

It is an object of these embodiments to provide a more compact utility knife with a rotatable blade that does not require a screw or cam mechanism for holding the blade in place.

It is another object of the embodiments to provide a convertible utility knife and scrapper blade that does not require a complicated spring system to operate the rotational function.

It is another object the embodiments to use features of the handle to support the blade in the scraper position rather than a specialized carriage mechanism to support the blade when in the scrapper position.

In order to achieve these objectives and others evident from the description below, presently preferred embodiments are convertible tools that include an elongated housing having a front and rear end and an internal channel through the longitudinal axis, with an opening at the front end and an elongated opening along the side of the housing with cut outs spaced along the elongated opening. The sides of the opening at the front end of the housing have slits horizontally across the elongated housing that allow for the blade to be retracted partially into when in the scraper position.

A slide mechanism sits inside the elongate housing and moves inside the housing between extended and retracted positions. Moreover, in certain embodiments, the slide mechanism includes a stud made to fit the center hole of a standard utility blade, thereby allowing for the blade to rotate freely when not confined by the housing. The upper portion of the slide mechanism fastens over the top of the stud at the front of the slide, securing the blade while allowing for the blades free rotation when not confined by the housing. The slide mechanism also engages cutouts in the housing to secure the slide mechanism, complete with the blade, in various selected positions between fully retracted and fully extended. A button attaches to the slide to allow for the locking tabs on the slide to be disengaged so the slide and blade may move forward and backward between the extended and retracted positions.

BRIEF DESCRIPTION OF THE DRAWINGS

FIG. 1 shows a first embodiment of the tool assembled and in the fully retracted position.

FIG. 2 shows the embodiment disassembled into its constituent parts.

FIG. 3 shows the embodiment with the blade partially extended in the cutting position FIG. 4 shows the embodiment with the blade partially extended and locked into the scraper position.

FIG. 5 shows the embodiment in the fully extended position allowing for the free rotation of the blade.

FIG. 6 shows the second embodiment in the fully retracted position.

FIG. 7 shows the second embodiment disassembled into its constituent parts.

FIG. 8 shows the second embodiment in one of the cutting positions.

FIG. 9 shows the second embodiment in the scraping position

DESCRIPTION OF PREFERRED EMBODIMENTS

Figure 1:
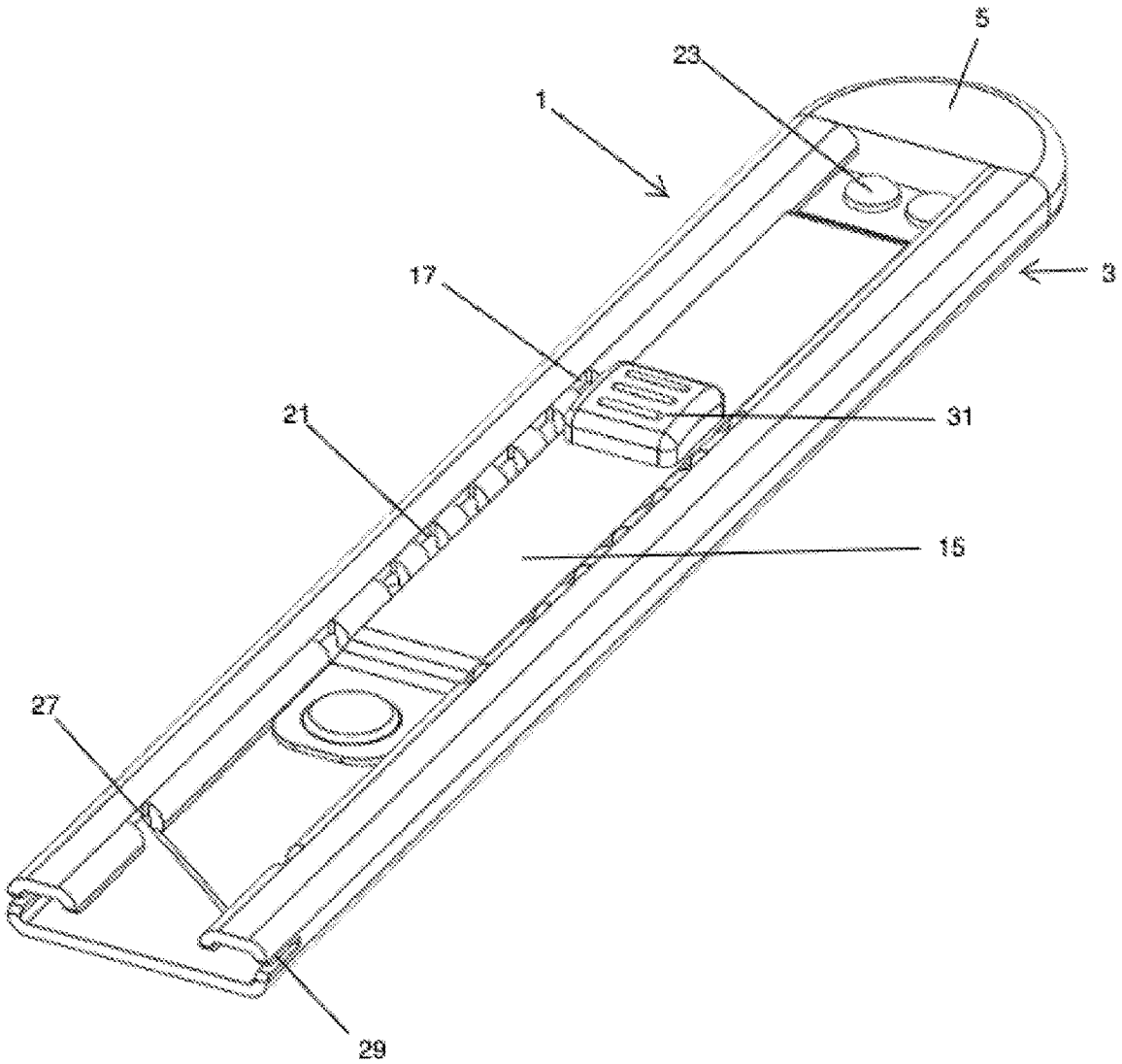
FIGS. 1 through 5 refer to the same embodiment of the utility knife and scraper tool.
Figure 2:
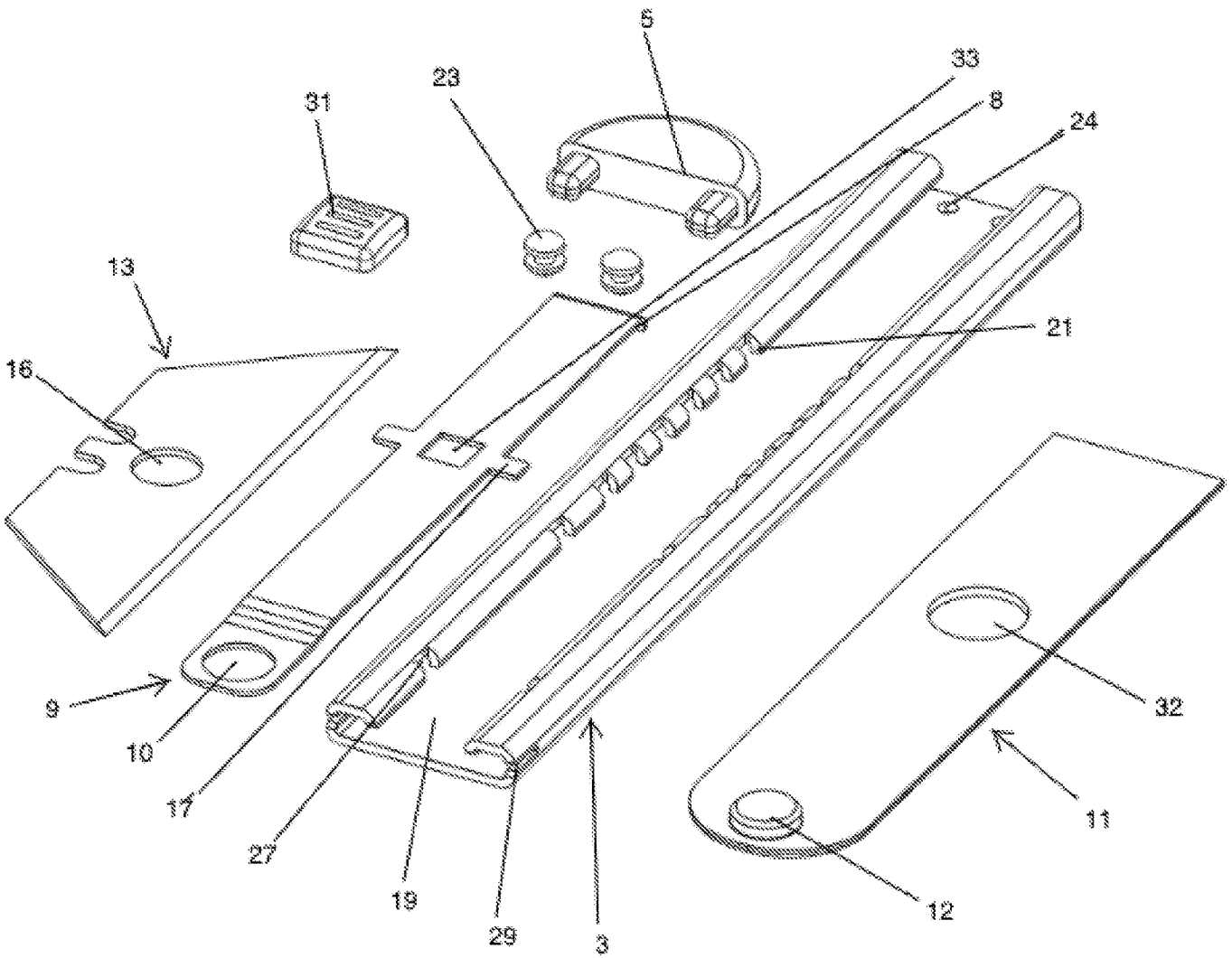

Referring now specifically to the figures, in which identical or similar parts are designated by the same reference number, and first referring to FIG. 1, the convertible utility knife and scraper tool is generally designated by the reference number 1. FIG. 1 shows an embodiment of a tool in the fully retracted position. The elongate housing 3 is joined by fasteners, such as rivets 23 disposed through openings 24 (as shown in FIG. 2), to the rear cap 5. The slide assembly 15 sits inside the housing 3.

FIG. 2 shows the first embodiment disassembled into its parts, with FIG. 1 depicting any elements not found in FIG. 2. The housing 3 contains the blade 13 and the slide assembly 15. The slide assembly includes the flat spring 9 secured on top of the lower slide 11, fixed by the rear clip 8 at the back of the flat spring 9 and at the front by opening 10 over the stud 12 at the front of the lower slide 11.

The button 31 mounts through the flat spring button mounting hole 33, which is positioned directly over the slide button mounting hole 32. The coupling mechanism created by the lower stud 12 on the lower slide 11 and the front opening 10 on the flat spring 9 secures the utility blade 13 in place via the blade mounting hole 16. The slide assembly 15, complete with the utility blade 13, is set inside the housing 3 and may move forward and backwards along the channel 19 when the button 31 is depressed. The slide assembly 15 with the utility blade 13 is fixed into place by the locking tabs 17, which lock into position inside the locking cutouts 21 of the housing 3 when the button 31 is not depressed.

Figure 3:
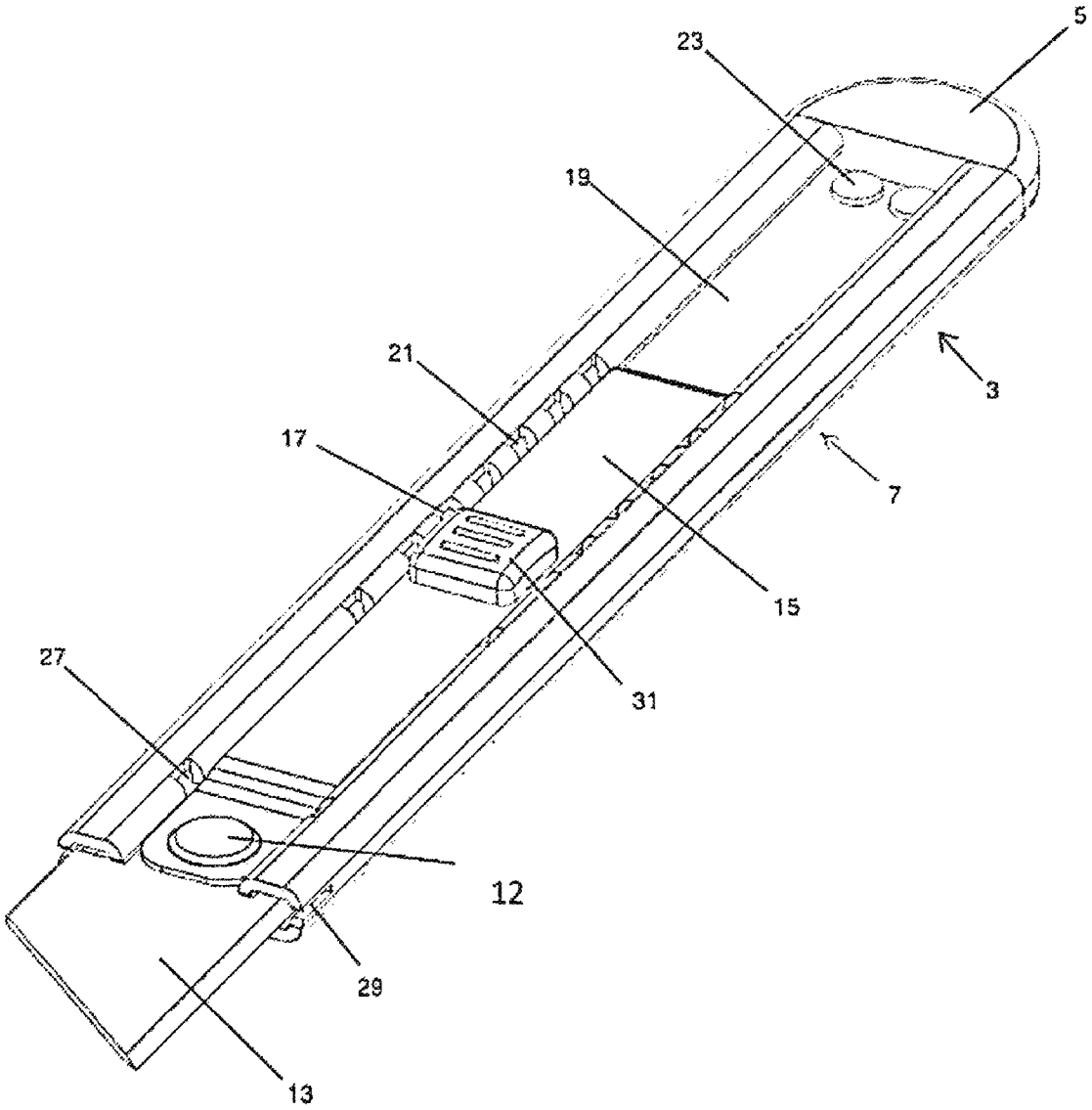

FIG. 3 shows the utility knife and scraper tool in the cutting position. The slide assembly 15 is advanced to expose a portion of the utility blade 13. Multiple positions may be selected to expose increasing amounts of the blade in various cutting positions. The locking tabs 17 are locked into one set of the locking cutouts 21 near the front of the handle 7. From the cutting position, the blade may be extended to another cutting position, to the fully extended position (FIG. 5), or to the fully retracted position (FIG. 1).

Figure 4:
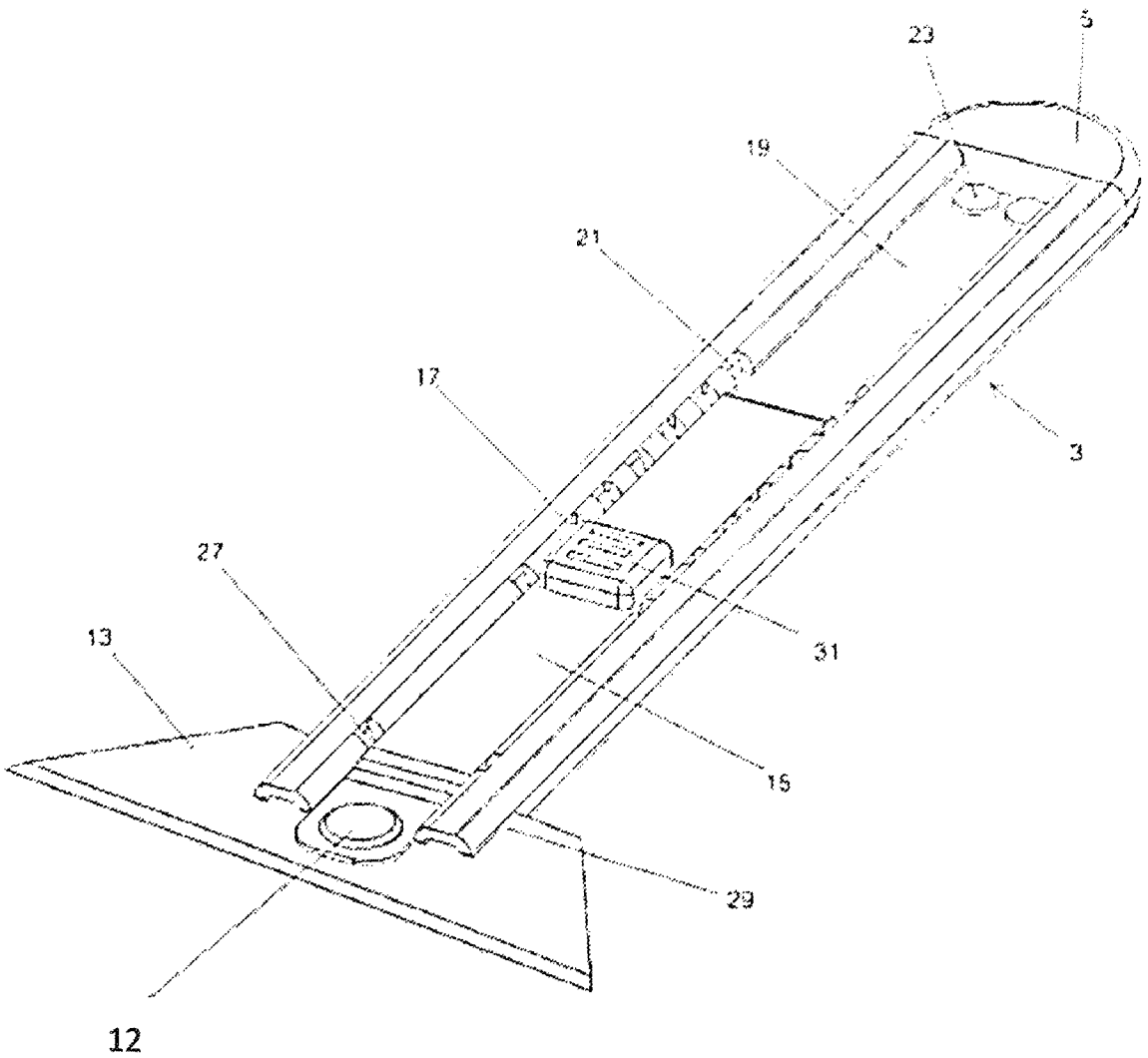

FIG. 4 shows the blade locked into the scraper position. When retracted from the fully extended position into the scraper position with the utility blade perpendicular to the housing 3, the blade is secured in place by the blade securing tabs 29 on the front of the housing 3 and locked into place by the locking tabs 17 on the flat spring 9 when the button 31 is released. The blade securing tabs 29 on the front of the housing 3 act to support the blade when in the scraper position (FIG. 4).

Figure 5:
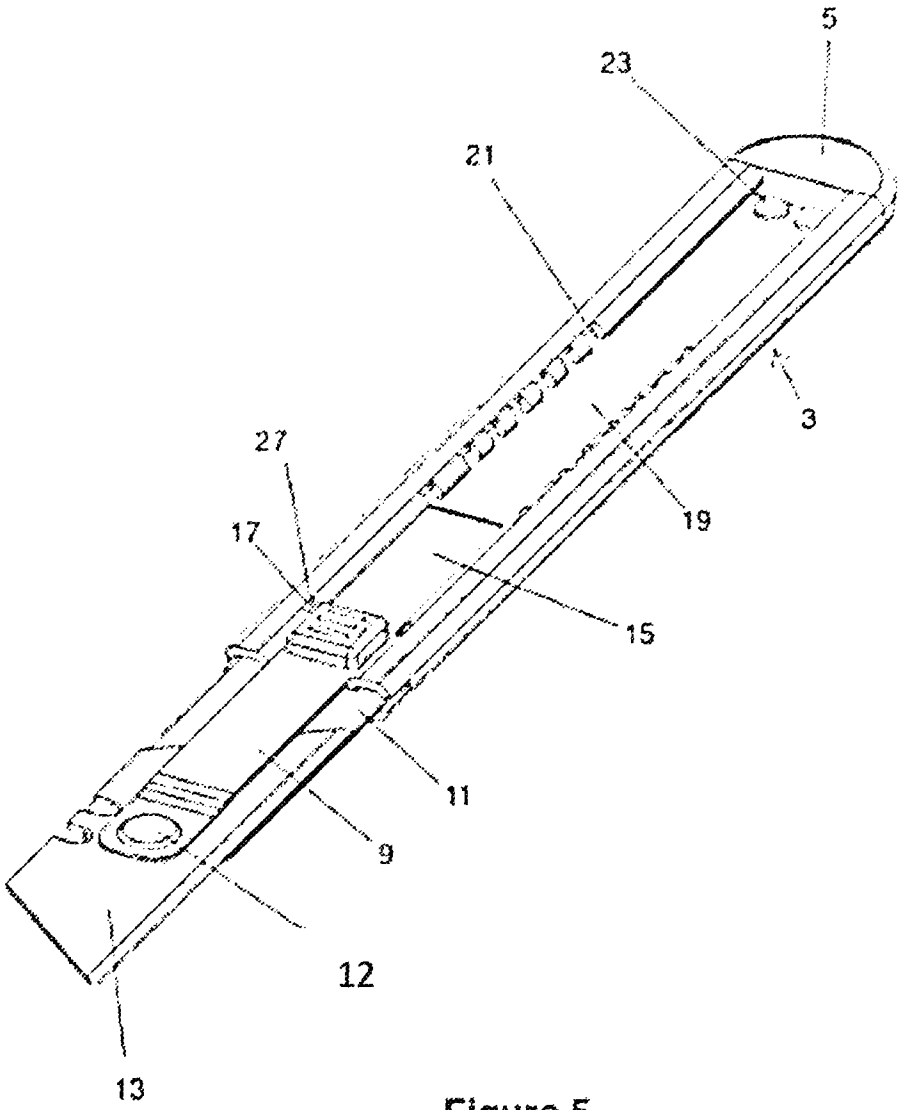

FIG. 5 shows the utility knife and scraper with the slide assembly 15 fully extended to allow for the free rotation of the utility blade 13 about the stud 12 on the lower portion 11 of the slide assembly 15. The assembly is stopped by the stop cutouts 27 in the housing 3, which prevent the locking tabs 17 from traveling any farther. From the fully extended position, the blade may be rotated into the desired orientation and retracted into the scraper position (FIG. 4), a chosen cutting position (FIG. 3), or to the fully retracted position (FIG. 1).

Figure 6:
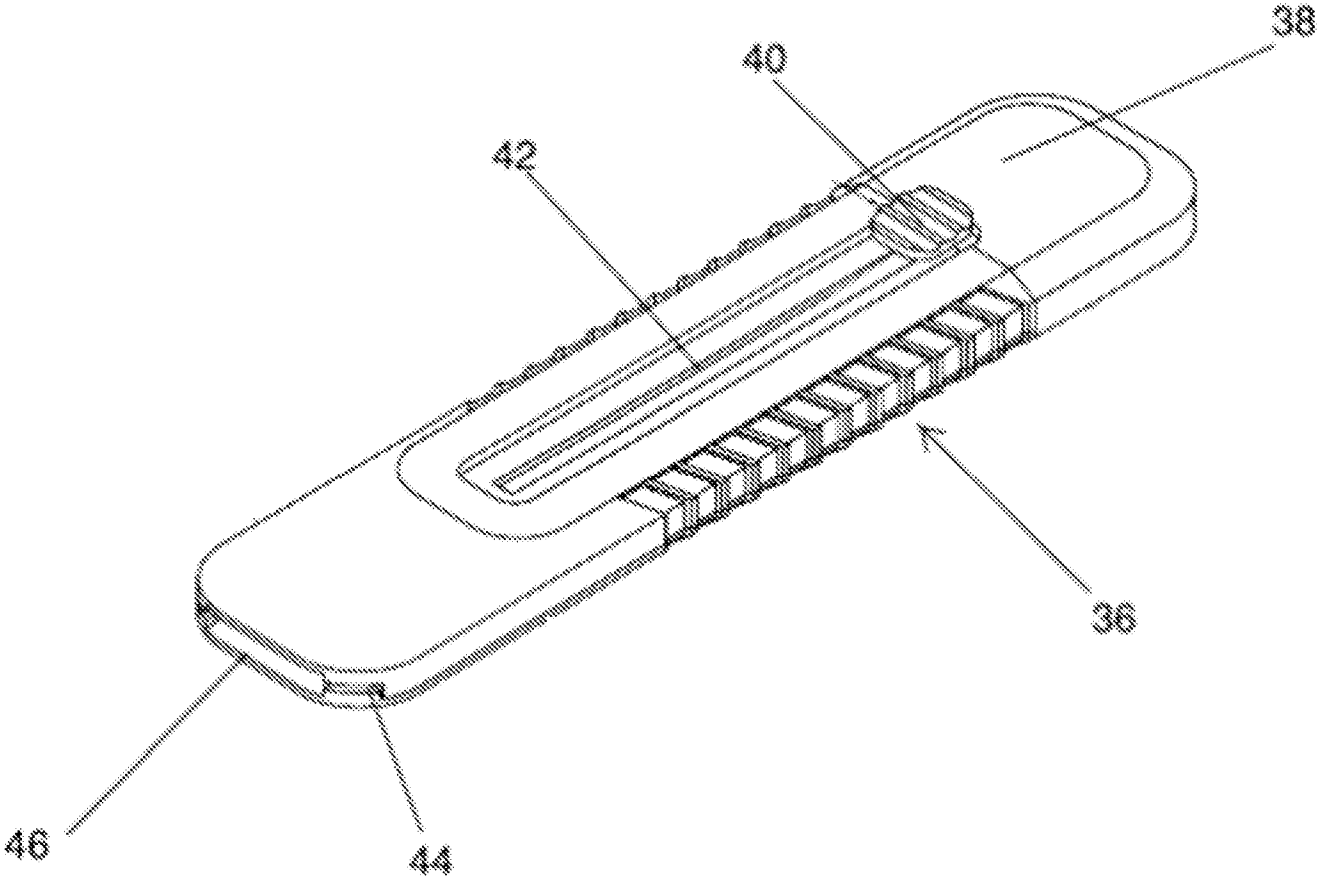
FIGS. 6 through 9 refer to a second embodiment of the tool.
Figure 7:
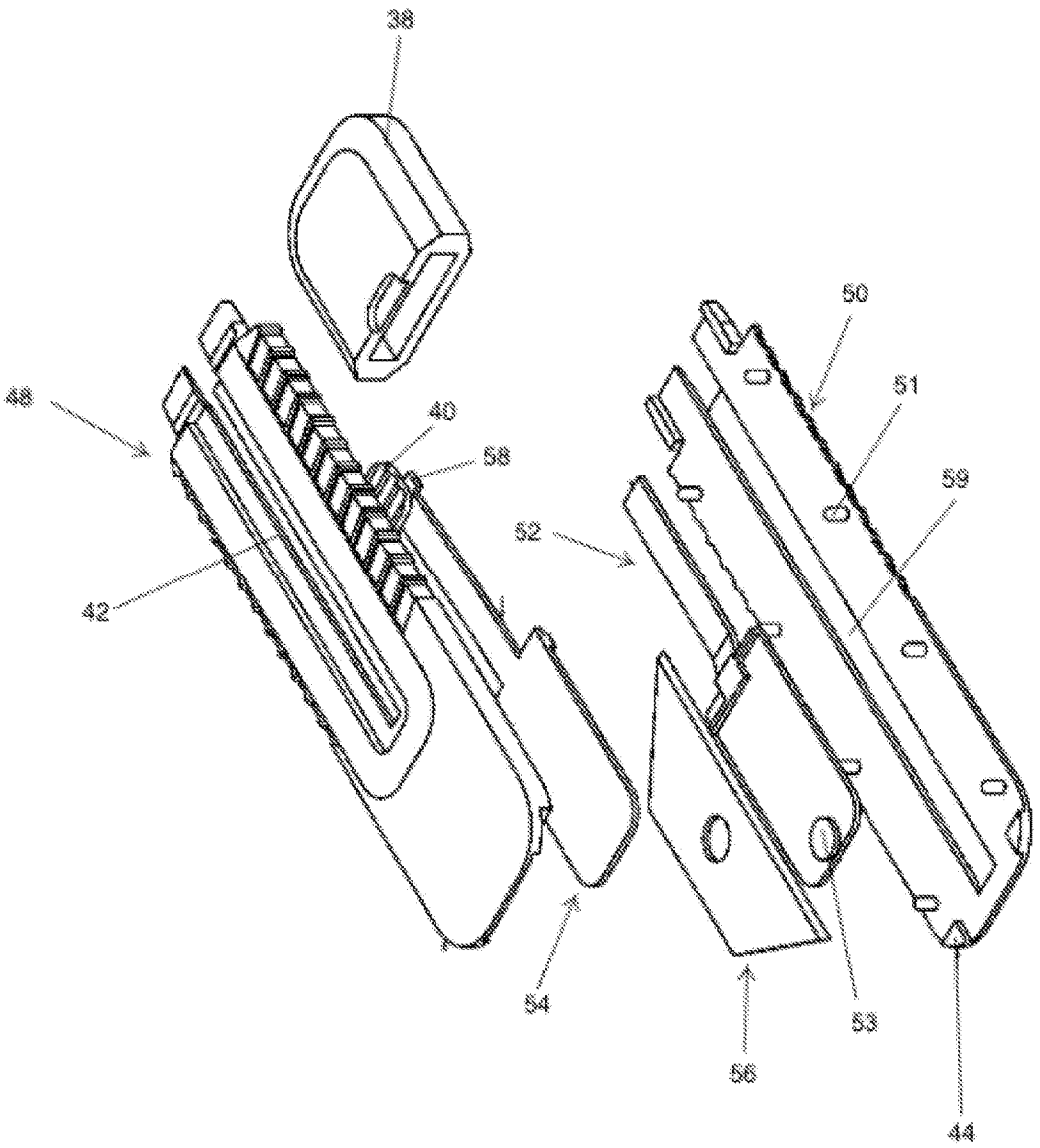
Figure 8:
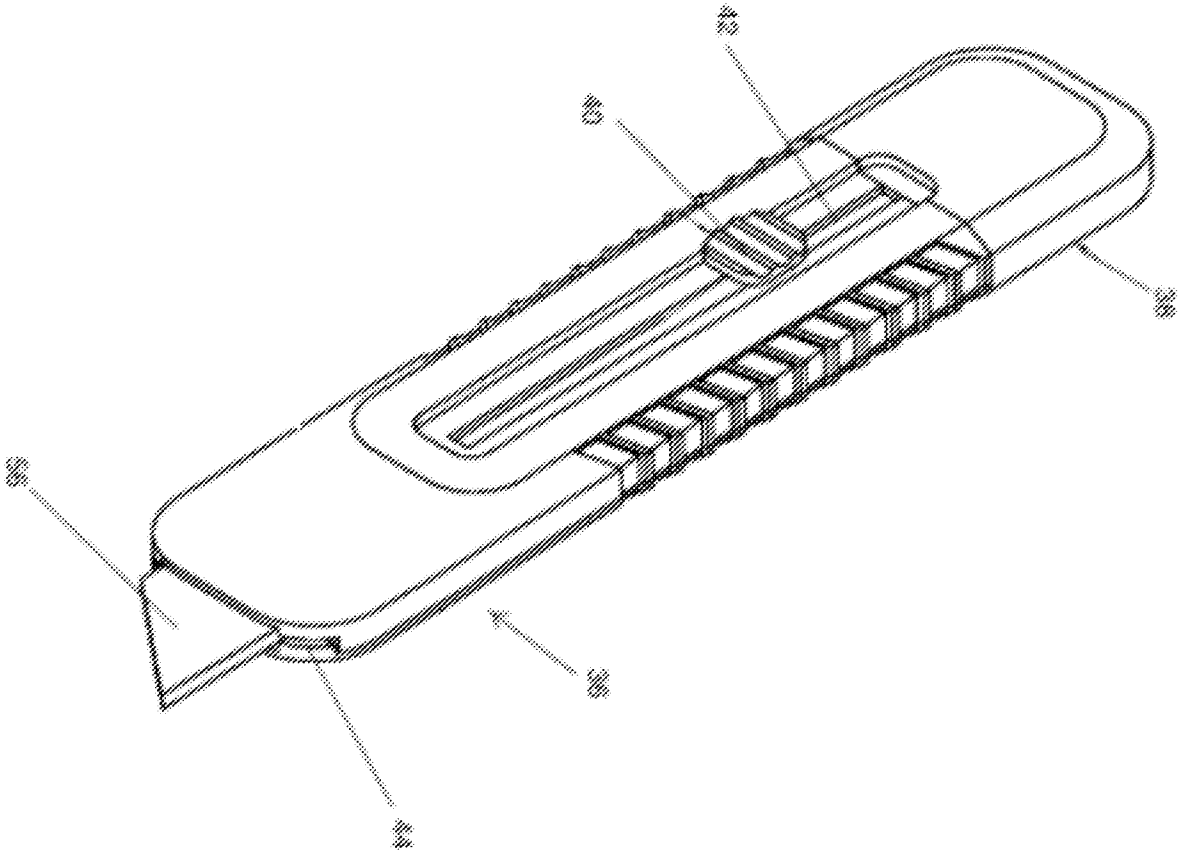
Figure 9:
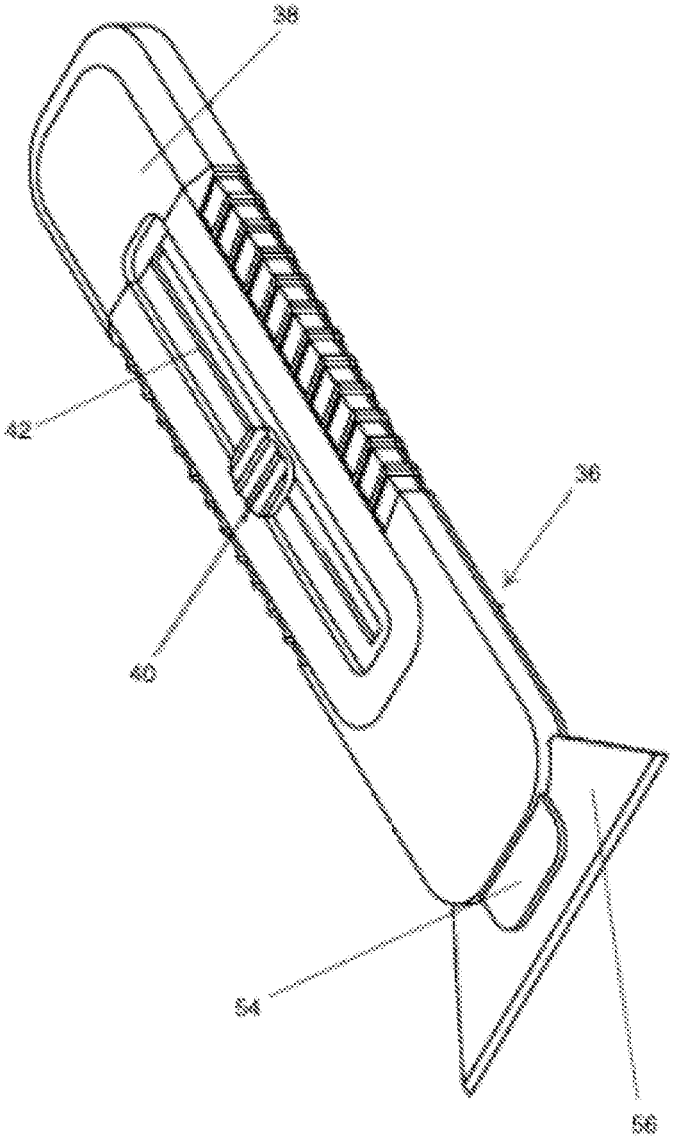

Another embodiment of the device is shown in FIG. 6 through FIG. 9. Referring first to FIG. 6 and FIG. 7, which show the device assembled and disassembled respectively and any reference numbers not in FIG. 6 in FIG. 7, the housing 36 is comprised of two portions, an upper housing 48 and a lower housing 50, which may be secured together by pins 51 on lower housing 50 and corresponding recesses (not shown) in upper housing 48, and an rear cap 38. The spring and slide assembly, made up of the upper slide 54 and the lower slide 52, rides inside the channel 46, which includes slot 59, created by the upper housing 48 and lower housing 50. The locking tabs 58 on the upper slide 54 engage into slots inside of the upper portion of the housing 50 (like the locking cutouts 21 in the first embodiment) to lock the slide assembly into place.

An elongate opening along top portion of the housing 36 forms the button channel 42, which allows for the button 40 to be in communication with the upper slide 54 and slide along the opening when the button is depressed and allows for the operation of the tool. Depressing the button 40 allows for the slide assembly to travel along the channel 46 on the interior of the housing. Releasing the button engages the locking tabs 58 on the inside of the housing, securing the blade in a fixed position.

The blade is secured in the tool by the stud 53 on the lower slide 52 and by the surface of the upper portion of the slide 54. In the fully extended position, the blade 56 may rotate freely about the stud 53 such that the blade 56 may be positioned in either the cutting (FIG. 8) or scraping orientation (FIG. 9) before being retracted into the housing and secured in place. When in the scraping position, blade 56 securing tabs 44 on the front of the housing created by cutouts on both the upper 48 and lower 50 portion of the housing secure and support the blade 56.

While many exemplary embodiments are herein described and illustrated, such description and illustration are not meant to limit the claims.

What is claimed:

1. A convertible tool comprising an elongate housing having a front end and a rear end, and an elongate internal channel defining a longitudinal axis having an opening at the front end and an elongate opening in a sidewall of the housing in communication with the channel extending along a direction parallel to the longitudinal axis;

a slide mechanism within said channel, the slide mechanism movable between a fully extended position and a fully retracted position and having a mounting pivot configured to mount a utility blade with an opening;

a button accessible exteriorly of the housing and coupled to the slide mechanism through the elongate opening and configured to move the slide mechanism between the fully extended and fully retracted positions; and blade securing tabs disposed on the front end of the housing and configured to support and stabilize the blade when the blade is rotated into a position perpendicular to the elongate housing, wherein the utility blade freely rotates about the mounting pivot when the slide mechanism is in the fully extended position.

2. The convertible tool as defined in claim 1, wherein the slide mechanism is comprised of a lower portion and an upper portion, the upper portion having a tab on either side of the upper portion in communication with the button;

and the sidewall of the elongate housing having cutouts that are engaged by the tabs on the upper portion of the slide mechanism to secure the slide mechanism in a given position when the button is not depressed.

3. The convertible tool as defined in claim 2, wherein the cutouts that are engaged by the tabs on the upper portion of the slide mechanism to secure the slide mechanism are located on an internal side of the sidewall.

4. The convertible tool as defined in claim 1, wherein the slide mechanism is of unitary construction.

5. The convertible tool as defined in claim 1, wherein the housing is comprised of an upper portion and a lower portion that, when joined, encapsulate the slide mechanism in the channel.

* * * * *